US006138641A

United States Patent [19]

Moser

[11] Patent Number: 6,138,641

[45] Date of Patent: Oct. 31, 2000

[54] FUEL INJECTION DEVICE FOR AUTO-IGNITION INTERNAL COMBUSTION ENGINES

[75] Inventor: Franz X. Moser, Kürten, Germany

[73] Assignee: Deutz AG, Cologne, Germany

[21] Appl. No.: 08/894,660

[22] PCT Filed: Mar. 5, 1996

[86] PCT No.: PCT/EP96/00908

§ 371 Date: Dec. 8, 1997

§ 102(e) Date: Dec. 8, 1997

[87] PCT Pub. No.: WO96/28654

PCT Pub. Date: Sep. 19, 1996

[30] Foreign Application Priority Data

Mar. 9, 1995 [DE] Germany ..... 195 08 445

[51] Int. Cl.[7] ..... F02M 41/00

[52] U.S. Cl. ..... 123/456; 123/509

[58] Field of Search ..... 132/509, 456, 132/446, 508, 468–9

[56] References Cited

U.S. PATENT DOCUMENTS

| | | | |
|---|---|---|---|
| 1,966,032 | 7/1934 | Hasbrouck | 123/456 |
| 1,991,586 | 2/1935 | Vincent | 123/456 |
| 5,007,401 | 4/1991 | Grohn | 123/509 |
| 5,197,438 | 3/1993 | Yamamoto | 123/446 |
| 5,390,642 | 2/1995 | Thoma | 123/509 |
| 5,398,658 | 3/1995 | Mesimaki | 123/509 |
| 5,404,855 | 4/1995 | Yen | 123/456 |
| 5,419,298 | 5/1995 | Nolte | 123/509 |
| 5,533,485 | 7/1996 | Bronkal | 123/456 |
| 5,564,395 | 10/1996 | Moser | 123/509 |
| 5,603,303 | 2/1997 | Okajima | 123/509 |
| 5,692,477 | 12/1997 | Berger | 123/509 |

FOREIGN PATENT DOCUMENTS

| | | |
|---|---|---|
| 0438163 | 7/1991 | European Pat. Off. . |
| 0637682 | 2/1995 | European Pat. Off. . |
| 39 10 794 | 10/1990 | Germany . |
| 43 40311 | 12/1994 | Germany . |
| WO 8700582 | 1/1987 | WIPO . |

*Primary Examiner*—Thomas N. Moulis

*Attorney, Agent, or Firm*—Nexsen Pruet Jacobs & Pollard, LLP; Charles L. Schwab, Esq.

[57] ABSTRACT

A very compact and inexpensive fuel injection device for auto-ignited internal combustion engines can be mounted on existing internal combustion engines to replace conventional fuel injection devices. The fuel injection device has one or more high-pressure pumps (10) that feed fuel into a supply tank (11) from which the fuel may be supplied through proportioning valves (16) to injection valves (15, 15'). The pressure in supply tank (11) is maintained by an automatic control system for the high-pressure pumps (10), the outputs of which are controlled by a control rod (13) that adjusts a plunger (18) of the high-pressure pumps (10) provided with a slanting edge (17).

11 Claims, 3 Drawing Sheets

FUEL INJECTION DEVICE FOR AUTO-IGNITION INTERNAL COMBUSTION ENGINES

TECHNICAL FIELD

This invention relates to a fuel injection device for an autoignition internal combustion engine having a crankshaft rotatably supported in a crankcase, to which crankshaft there is articulated at least one connecting rod bearing a piston, the piston being movable in a cylinder covered by a cylinder head, the fuel injection device having at least one high-pressure fuel-conveying pump, which conveys the fuel into a supply reservoir (common rail), which is connected to at least one injection valve via at least one proportioning valve.

BACKGROUND OF THE INVENTION

Such a fuel injection device is known from the brochure "Reliable Electronic Injection with Future Fuel Qualities" of the MAN company, dated April 1980. The fuel injection device described in the beforementioned brochure is designed for use with a two-stroke marine diesel engine. This fuel injection device has a fuel pressure reservoir, from which the fuel, at an approximately constant pressure of approximately 700 bar, can be withdrawn under electronic control for delivery to the individual injection valves. This entire control is constructed so that, in addition to the electronic control, it further requires a working fluid in the form of a hydraulic fluid, with which the individual valves and control elements are actuated. Further, the components "cylinder unit and high-pressure pump," which are illustrated at least approximately to scale, are arranged far apart so that, together with the fuel pressure reservoir arranged at another location on the internal combustion engine, long connecting lines are needed for the pressurized fuel. Because of the long lines, the system as a whole is hydraulically soft, so that the advantages achievable in principle with the illustrated fuel injection system are not achieved.

OBJECTS AND SUMMARY OF THE INVENTION

It is an object of the invention to create a fuel injection device for an autoignition internal combustion engine, which fuel injection device is made hydraulically stiff and compact in construction.

According to the invention, this object is achieved by virtue of the fact that the high-pressure pump is inserted into the crankcase and is arranged with its high-pressure side in a region near a cylinder and is driven from a camshaft on its drive side. This design, in development of the fuel injection device of the stated type, creates an injection device that is, as a whole, made mechanically and hydraulically very stiff, from the camshaft drive, through the arrangement and alignment in the crankcase, up to the arrangement of the high-pressure delivery as close as possible to the injection valve or to the supply reservoir interposed or integrated into the cylinder head, and that improves the injection behavior of the internal combustion engine according to the invention relative to the prior art. Exactly definable and controllable injection behavior is especially important with regard to low fuel consumption and favorable emission behavior of the internal combustion engine. Both the exhaust emissions of the internal combustion engine and also its noise emissions, insofar as they are influenced by the injection device, are reduced. A hydraulically stiff system is definitely important especially when a supply reservoir is used, since it is the total injection quantity per working cycle, which with this system can, for example, be split into a pre-injection quantity and main injection quantity, that must be metered most accurately. Weaknesses in the injection system, even those that would be unobjectionable in a conventional system, have very detrimental impact in an injection system where the total injection quantity is split into a pre-injection quantity and a main injection quantity.

In development of the invention, the high-pressure pump is inserted without enclosure into the crankcase. This design has the advantage that, on the one hand, a separate enclosure for the high-pressure pump is saved and, on the other hand, the entire system becomes mechanically stiffer by this means, since space is saved by means of the elimination of a separate pump enclosure, which space can be employed for a reinforcement of the crankcase in this region. The otherwise necessary fits or connections of the pump enclosure to the crankcase are also eliminated by virtue of the elimination of the separate pump enclosure, which has an impact at least with regard to the machining effort.

In development of the invention, the high-pressure pump is an injection pump element having edge control. This design permits the use of already available and tested pump elements, with which, moreover, it is made certain that these can deliver the required pressures in the range of approximately 1400 bar. Edge control, furthermore, permits accurate and reliable control of pressure in the supply reservoir without costly overpressure and drain valves being necessary in the supply reservoir. These elements can be saved by means of active control of the charge pressure of the supply reservoir.

In development of the invention, the camshaft has cams for breathing valve actuation and is driven from the crankshaft via a single gear engagement. This design is advantageous particularly in an in-line internal combustion engine, since by this design a separate camshaft for driving the high-pressure pump is saved. Also, the camshaft is advantageously designed so that three cam segments are arranged directly next to one another at least in partial regions along the camshaft and are bracketed by bearings. Here two cam segments are needed for the control of the breathing (intake and exhaust) valves, while the third cam segment is used for actuation of the high-pressure pump. The camshaft is further stiffened by means of the bracketing of these segments by bearings, so that sources of error stemming from flexure or torsion of the camshaft are nearly eliminated. The bearings and the cam regions lying therebetween can also be made to transition from one to the other in a transitionless fashion, that is, without recesses. A further contribution to a stiff camshaft is made by this design having a minimum space requirement. Torsions of the camshaft relative to the crankshaft, which occur in known camshaft drives via a plurality of gears, toothed belts or chains, and which reduce the achievable peak pressure to impair exact control, are averted by the drive of the camshaft from the crankshaft by a single pair of meshing gears.

In development of the invention, the camshaft has two, three or a plurality of cam distributed over the periphery of the camshaft for driving the high-pressure pump. This design has the advantage that the high-pressure pump can charge the supply reservoir a plurality of times upon a single rotation of the camshaft. In contrast to an injection pump element, the charging of the high-pressure reservoir is independent of what operating stroke is in progress, to which operating stroke the injection pump element together with the injection valve must be aligned. Furthermore, the flanks of the cam can be reshaped in that the steep flanks required for injection pump elements are made less sharp for the supply reservoir supply pumps, since—as already discussed above—no steep pressure rise is required with high-pressure pumps as is required with injection pump elements for compliance with specified injection laws. Instead, the cams can be optimized with respect to the loading of the high-pressure pump and of the entire system. The number of cams arranged on the periphery of the camshaft therefore depends on the particular circumstances of the internal combustion engine (number of cylinders, size of high-pressure pump, etc.).

In development of the invention, two or more high-pressure pumps are arranged along the internal combustion engine. Here again, what was stated before holds: that optimization is done in accordance with the aforementioned parameters (number of cylinders, delivery volume of the high-pressure pump, etc.).

In development of the invention, the supply reservoir extends along at least one cylinder row of the internal combustion engine. By this construction, in cooperation with the already discussed close arrangement and alignment of the high-pressure pump to a cylinder head having the assigned injection valve, a further contribution is made to a stiff system, since the length of the connections from high-pressure pump to supply reservoir and from supply reservoir to the individual injection valves are shortened to the greatest possible extent by this construction. If the internal combustion engine is of the V type, a single supply reservoir can, according to the invention, be arranged in the V-shaped space between the two cylinder rows, this design suggesting itself particularly in the case of small V angles, that is, when the two cylinder rows are aligned relatively close together. Otherwise, it is also contemplated in the context of the invention to provide two supply lines, one supply reservoir then being assigned to one cylinder row. The supply reservoir(s) can also advantageously be integrated into the cylinder head.

In development of the invention, the supply reservoir is connected to the high-pressure delivery of the high-pressure pump via a short pressure line. By this design, as already indicated, the losses or pressure fluctuations that occur with long pressure lines are virtually eliminated. In further development of the invention, the supply reservoir is borne by two or a plurality of high-pressure pumps. This design is desirable especially when, for example, there are two or three high-pressure pumps that are distributed along the internal combustion engine, for example at the two ends and in the middle of a cylinder row, the supply reservoir then being attached directly to these high-pressure pumps. As an alternate design, a complete unit consisting of high-pressure pumps and supply reservoir can be preassembled, and mounted as a unit on the internal combustion engine. This eliminates the separate attachment of a supply reservoir.

The proportioning valve may be arranged on the supply reservoir or it may be placed on the injection valve. The arrangement is chosen that best suits the existing requirements. Thus a proportioning valve arranged directly on the injection valve can control the quantity of fuel being proportioned to the injection valve very accurately in terms of quantity and time, since no lines negatively impairing proportioning are present between the proportioning valve and the injection valve. On the other hand, a proportioning valve arranged on the supply reservoir again offers the possibility of creating a very compact unit, also to be prefabricated or preassembled, consisting of high-pressure pump, supply reservoir and proportioning valves. Moreover, the required height is reduced by means of the elimination of the proportioning valve in the region of the cylinder head, which height is scarcely available in many applications. In development of the invention, the proportioning valves can be at least largely solenoid-actuated valves, which already find use in convention solenoid-valve-controlled injection systems (MV systems of the Deutz AG). These are systems in which the injection pump element is provided with such a solenoid-actuated valve that controls the quantity of fuel to be delivered to an injection valve connected to an injection pump element or solenoid-actuated valve. Piezoelectric switching elements can also be employed in order to actuate the proportioning valves.

In development of the invention, the pressure prevailing in the supply reservoir is employed for controlling the high-pressure pump. Suitable for this purpose is the already described design of the high-pressure pump with a pump plunger that has a control edge, this control edge then being connectable to corresponding drain holes by a control rod. The pressure prevailing in the supply line acts via a hydraulic and/or electric transmission on a control element that then actuates the control rod positioning the control edges. In the simplest embodiment, the supply line can be provided, for example at the end face, with a pressure transmission line, which opens into the control element made as a pressure transducer and that controls the control rod for positioning the control edges. Alternatively, however, the pressure in the supply reservoir can also be picked off electrically or via sensors and this measured value can be employed for positioning the control rod. An appropriate positioning motor, for example a stepping motor, can be used for this purpose. In just the same way, however, it is also possible to employ the electrical signals for driving a hydraulic positioning mechanism of the control rod.

In development of the invention, the control element is arranged at an end face of the internal combustion engine, in particular in place of a speed governor. This design has the advantage that no additional space requirement on the internal combustion engine is needed in order to mount such a control element. Instead, the internal combustion engine as a whole can be made such that it is optionally equipped with a conventional injection system with or without the above-described solenoid-actuated valve hardware, however, with the system having a supply reservoir according to the invention.

Finally, in development of the invention, the control element is inserted in an opening in the crankcase in place of an injection pump element. As already stated, not all of the openings present in a conventional internal combustion engine will be needed for the injection pump elements of the invention, since fewer high-pressure pumps are required in order to generate the necessary high pressure in the supply reservoir. Thus, the control element can be inserted in an unused injection pump opening. This control element is then constructed similarly, in principle, to a high-pressure pump, however it does not have a drive from the camshaft. Instead, the pressure transmitted hydraulically and/or electrically from the supply reservoir is then transmitted "quasi-backward" to the control rod for controlling the delivery quantity of the other high-pressure pumps. This design represents a particularly compact embodiment, this construction also being employable as support for the supply reservoir according to one of the previous designs.

The fuel injection device according to the invention can also be implemented with ordinary plug-in pumps. Here the injection pump element or the high-pressure pump is arranged in its own pump enclosure. This pump enclosure can be arranged chiefly in the crankcase of the internal combustion engine or partially in and partially on the same, and can have an external fuel supply in contrast to the fuel supply advantageously arranged in the crankcase in the design previously described. This arrangement offers the advantage that the high-pressure compartment of the high-pressure pump can be applied to the injection valve in close cooperation with the supply reservoir. Also, the danger of fuel heating and fuel leakage inside the crankcase is averted by use of the external fuel.

BRIEF DESCRIPTION OF THE DRAWINGS

Further advantageous developments of the invention can be inferred from the following description of the drawings, in which.

DETAILED DESCRIPTION OF THE INVENTION

Figure 1:
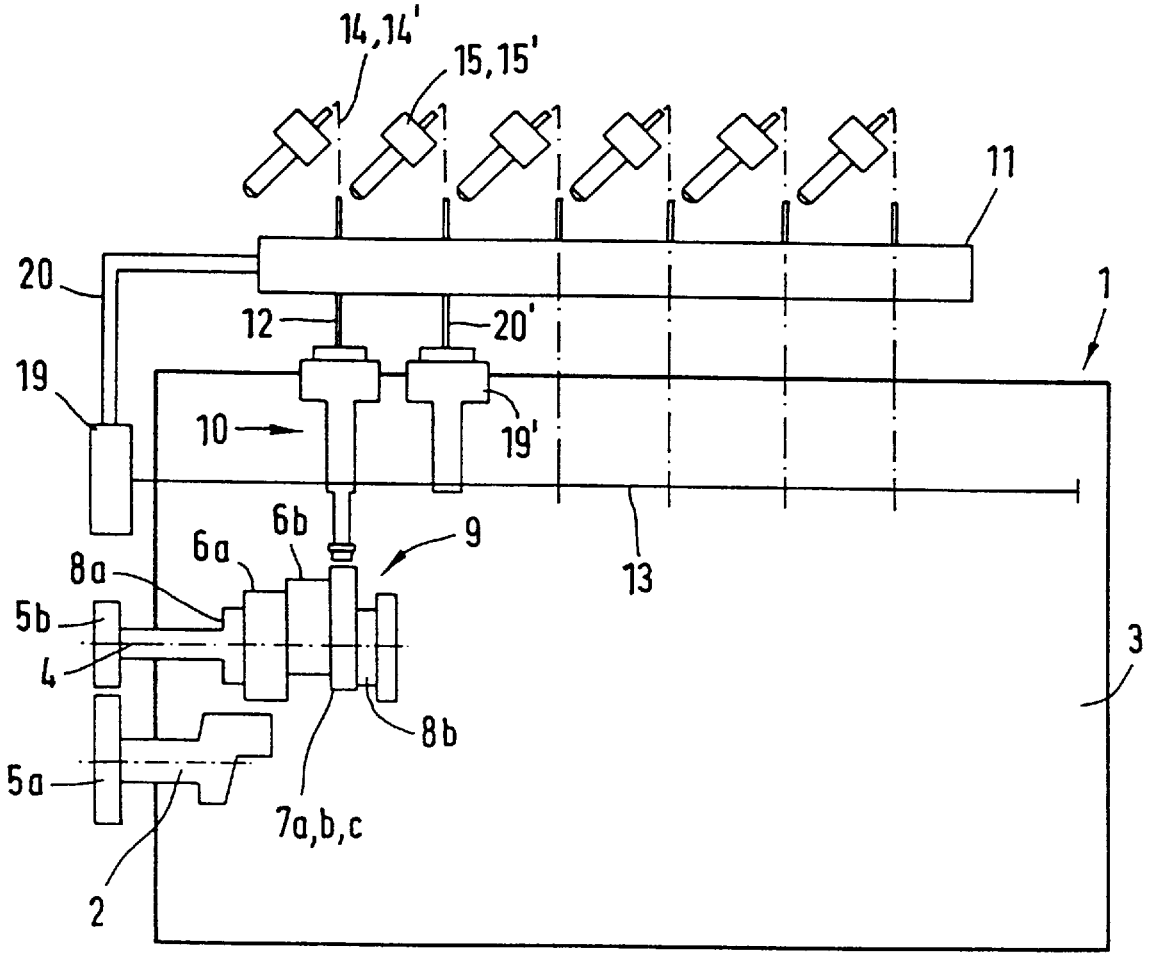
FIG. 1 is a schematic lateral view of an internal combustion engine having the fuel injection device of this invention.
Figure 2:
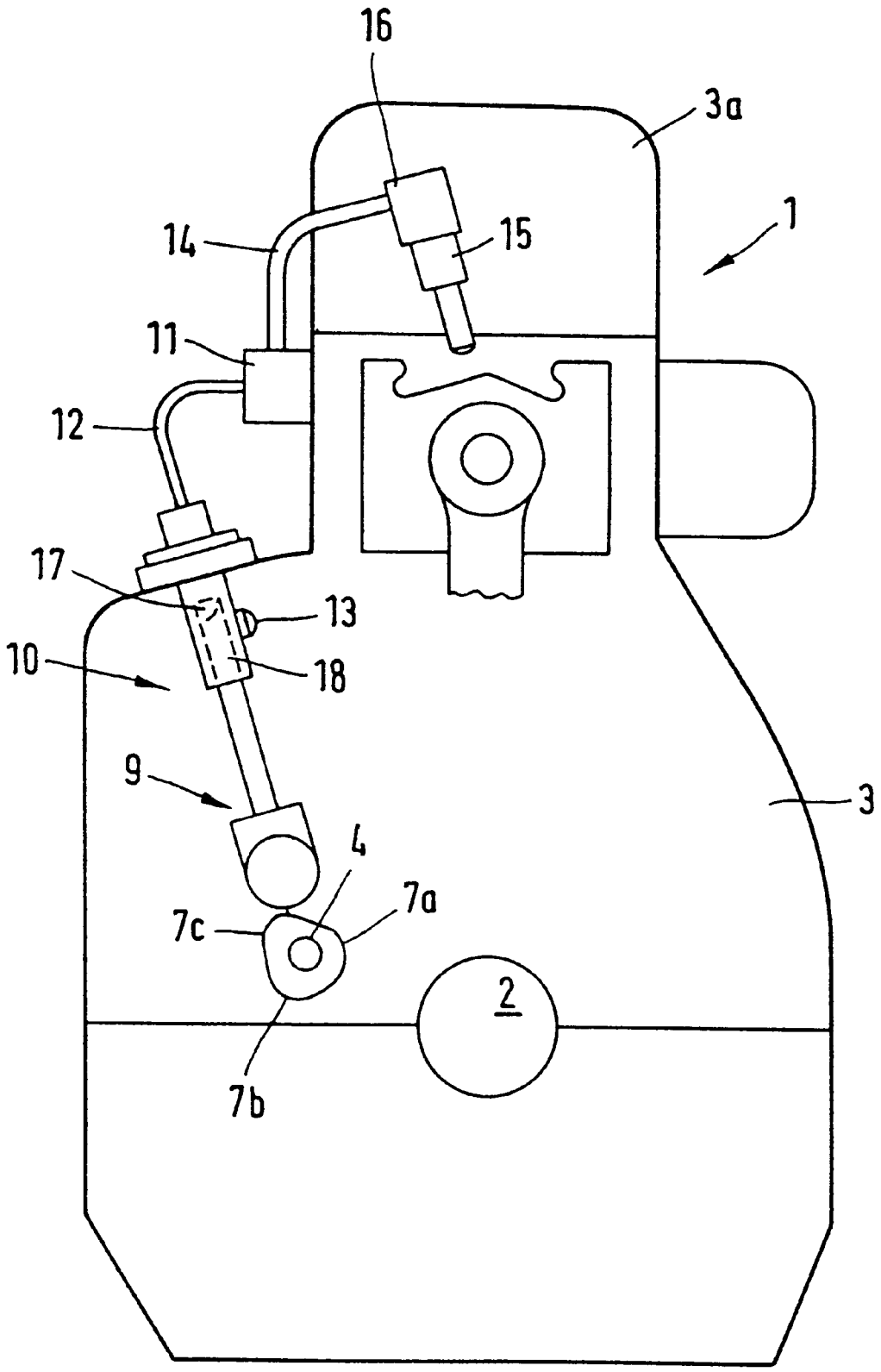
FIG. 2 is a schematic end view of an internal combustion engine having the fuel injection device of this invention, the supply reservoir being attached to the cylinder row and the proportioning valve being arranged on the injection valve
Figure 3:
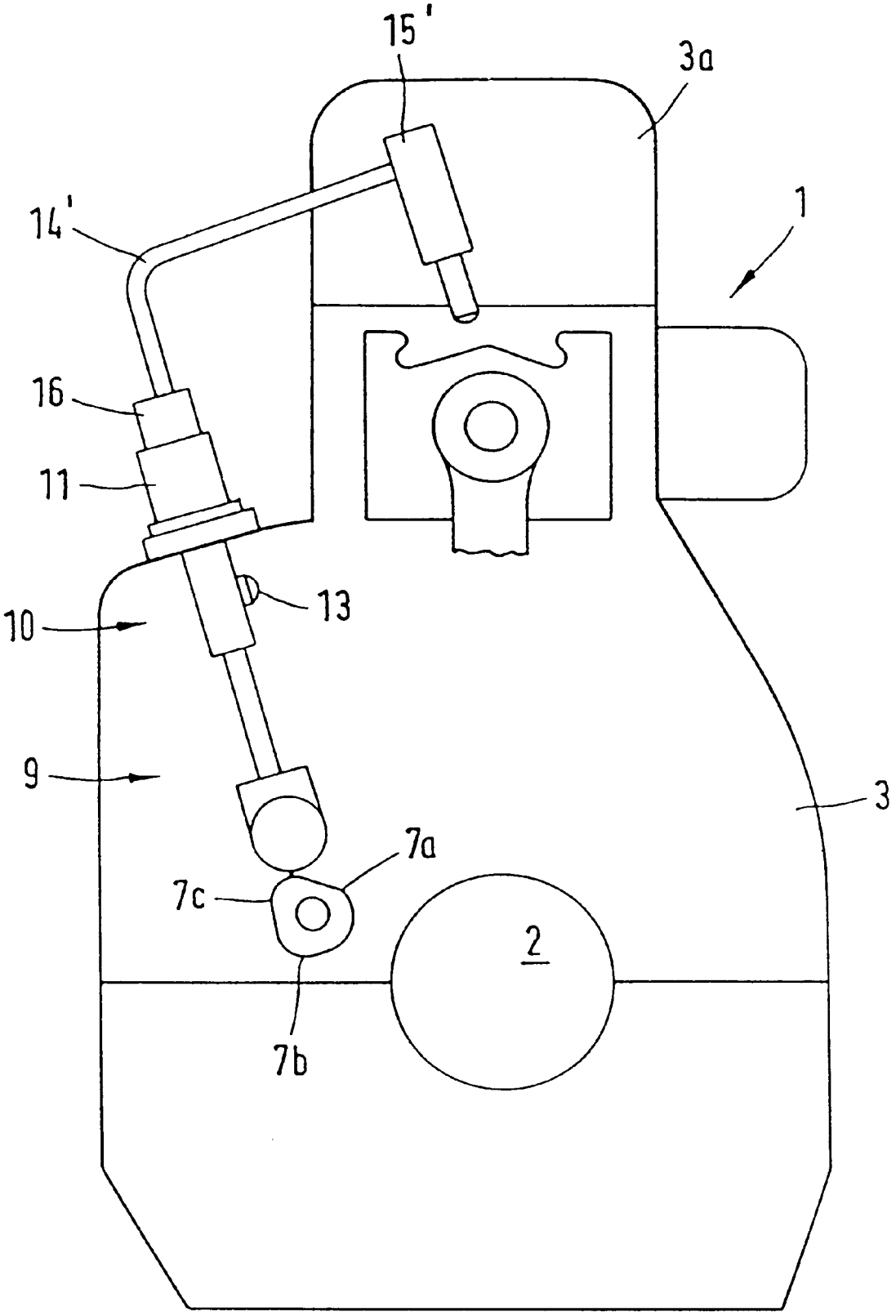
FIG. 3 is a schematic end view of an internal combustion engine incorporating an alternate embodiment of this invention, the supply reservoir being attached to the high-pressure pump and the proportioning valve being mounted on the supply reservoir.

The autoignition internal combustion engine 1 shown schematically in FIG. 1 has, in the exemplary embodiment, six cylinders which are arranged in a row. The internal combustion engine 1 is substantially conventionally constructed and has a crankshaft 2, which is supported in a crankcase 3 (see also FIGS. 2 and 3). Further supported in the crankcase 3 is a camshaft 4, the camshaft 4 being driven by the crankshaft 2 via a single gear engagement, that is, a pair of mating gears. For this purpose, gears 5*a,* 5*b* are arranged on the ends of the crankshaft 2 and the camshaft 4, which gears are designed so that the camshaft 4 is driven at half the speed of the crankshaft. The camshaft 4 has breathing-valve cams 6*a,* 6*b* assigned to each cylinder, adjoining which cams are further cams 7*a,* 7*b,* 7*c,* which are positioned in the same axial region of the camshaft 4 as the breathing valve cams 6*a,* 6*b* and lying on the periphery of the camshaft 4 (FIGS. 2 and 3). The breathing valve cams 6*a,* 6*b* and the cams 7*a,* 7*b,* 7*c* are bracketed by bearings 8*a,* 8*b,* which are directly adjacent to the breathing-valve cam 6*a* and the cams 7*a,* 7*b,* 7*c.* The transition from the bearings 8*a,* 8*b* to the individual cam regions takes place in a transitionless fashion, that is, essentially without recesses between the bearings and cams and without recesses between the individual cam regions. In FIG. 1, the bearings 8*a,* 8*b* with the cam regions lying therebetween are also shown only for one cylinder, similarly to the way the crankshaft 2 is shown in only a partial region. Both components in the illustrated design extend over the entire length of the internal combustion engine 1.

Referring also to FIG. 2, a roller tappet 9 of a high-pressure pump 10 rides on the cams 7*a,* 7*b,* 7*c* of the camshaft 4 and drives a pump plunger 18, which conveys fuel via a short pressure line 12 into a supply reservoir 11 (common rail) extending along the internal combustion engine 1. In terms of its basic construction, the high-pressure pump 10 includes an injection pump element having edge control. In other words, the previously mentioned pump plunger 18 has a control edge 17, which cooperates with a drain hole, depending on the rotation of the pump plunger 18. By this rotation, the delivery quantity of the high-pressure pump 10 can be varied between a zero delivery quantity and a maximum delivery quantity. The pump plunger 18 is positioned by a control rod 13, which extends along the internal combustion engine 1.

During operation of the internal combustion engine, fuel is continually conveyed by the high-pressure pump 10 into the supply reservoir 11. Injection lines 14 corresponding to the particular number of cylinders in the internal combustion engine 1 branch off from this supply reservoir 11, which injection lines are ultimately connected to an injection valve 15. According to the exemplary embodiment of FIG. 2, the supply reservoir 11 is mounted on and attached to the crankcase 3 or the cylinder bank. The injection lines 14 branching off from this supply reservoir 11 open into a proportioning valve 16 mounted on the injection valve 15. This proportioning valve 16 is designed, for example, as a solenoid-actuated valve controllable by an electronic control unit, which solenoid-actuated valve controls the fuel flow from the injection line 14 into the injection valve 15 in accordance with the respective operating parameters.

In distinction to the exemplary embodiment of FIG. 2, the supply reservoir 11 in the exemplary embodiment of FIG. 3 is attached directly to the high-pressure pump 10. Further, the proportioning valve 16 is in turn arranged directly on the supply reservoir 11, so that the injection line 14' opens directly into the injection valve 15'. The possibility of arranging the proportioning valve 16 directly on the injection valve 15 also exists in this exemplary embodiment. By use of the illustrated design of the internal combustion engine having a supply reservoir 11, the fuel is available in the supply reservoir at an approximately equal pressure of, for example, 1400 bar under virtually all operating conditions, and can be delivered via the proportioning valves 16 to the injection valves 15, 15' in a virtually arbitrarily controlled fashion. The running behavior of the internal combustion engine, in particular the exhaust emissions and noise emissions, and also the fuel consumption, can be positively influenced by this construction.

As previously discussed, the quantity to be delivered by the high-pressure pumps 10 is controlled by the pump plunger 18 provided with the control edge 17, which plunger is positioned rotatively by the control rod 13. The axial displacement of the control rod 13 effecting positioning is carried out by a control element in the form of a pressure transducer 19, which according to FIG. 1 is arranged on the end face of the internal combustion engine. This pressure transducer 19 is connected to the supply reservoir 11 via a control line 20. This system is tuned so that, if the pressure in the supply reservoir 11 decreases, this falling pressure is passed on to the pressure transducer 19 via the control line 20 and the pressure transducer 19 accordingly positions the control rod 13 so as to increase the delivery quantity of the high-pressure pumps 10. Simple automatic pressure control in the supply reservoir 11 is possible by this mechanism. In the context of the invention, the pressure in the supply reservoir 11 can also be picked off, for example by means of pressure sensors, and these signals passed on to the pressure transducer 19. The pressure transducer 19 in this case is preferably designed as an electrically actuated control element. As described in the general description, it is also provided in the context of the invention to insert the control element in the form of a pressure transducer 19' into an opening in the crankcase 3 of the internal combustion engine next to a high-pressure pump 10, in a manner similar to insertion of the pump. This control element is designed substantially similarly to a high-pressure pump 10 but it has no roller tappet 9. Instead, the pressure in the supply reservoir is transmitted by the control line 20' to the control element which in turn positions the control rod 13.

I claim:

1. A fuel injection device for an autoignition internal combustion engine including a crankcase having a row of cylinders, a piston in each of said cylinders, a crankshaft to which there is articulated connecting rods connected, respectively, to said pistons, and a cylinder head covering said cylinders, said fuel injection device comprising:

an opening in said crankcase at one lateral side of said row of cylinders for receiving a fuel pump (10), a high-pressure fuel-conveying pump (10) mounted in said opening in said crankcase, an elongated injection pressure fuel supply reservoir (11) secured to said high-pressure fuel-conveying pump (10) to form a unitary structure, said fuel supply reservoir (11) extending parallel to said crankshaft along said one side of said row of cylinders;

said high pressure fuel conveying pump (10) being connected in fuel delivery relation to said fuel supply reservoir (11) and operable to maintain fuel in said fuel supply reservoir (11) at a fuel injection pressure, a camshaft (4) driven by said crankshaft, a fuel injector (15) for each cylinder mounted in said cylinder head operable to inject fuel into the associated cylinder, individual fuel lines (14) of substantially equal length connecting said fuel supply reservoir (11) in fuel delivery relation to said fuel injectors (15) and a proportioning valve (16) interposed in each of said fuel lines (14), said proportioning valves (16) being operable to control timing and quantity of fuel delivery by said injectors (15), said high-pressure fuel conveying pump (10) having a high-pressure side at said one side of said row of cylinders and having a drive side drivingly engaged by said camshaft (14).

2. The fuel injection device of claim 1 wherein said high-pressure pump (10) has a cylinder and a pump plunger reciprocally movable within said cylinder, said pump plunger having a control edge for quantity control.

3. The fuel injection device of claim 1 wherein said camshaft (4) has cams **(6*a*, 6*b*) for breathing valve actuation and is driven by said crankshaft (2)** via a single pair of meshing gears.

4. The fuel injection device of claim 1 wherein said camshaft (4) includes a plurality of circumferentially spaced cams **(7*a*, 7*b*, 7*c*) distributed over the periphery of said camshaft (4) for driving said high-pressure pump (10)**.

5. The fuel injection device of claim 1 wherein said proportioning valves (16) are mounted on said supply reservoir (11).

6. The fuel injection device of claim 1 wherein said proportioning valves (16) are mounted respectively, on said fuel injectors (15, 15').

7. The fuel injection device of claim 1 wherein the pressure prevailing in the supply reservoir (11) is employed for controlling said high-pressure pump (10).

8. The fuel injection device of claim 1 and further comprising a control rod (13) supported in said crankcase (3) and connected in controlling relation to said high-pressure pump (10).

9. The fuel injection device of claim 8 wherein said high pressure pump (10) includes a plunger (18) having a control edge (17) for quantity control and further comprising an actuator for said control rod (13), a pressure sensing control element (19') connected in pressure sensing relation to said supply reservoir (11) and in controlling relation to said control rod (13) whereby said control edge (17) is moved in response to predetermined changes in pressure in said supply reservoir (11).

10. The fuel injection device of claim 9 wherein said control element (19') is mounted on an end face of said internal combustion engine (1) and wherein said control element (19') obviates the need for a speed governor.

11. The fuel injection device of claim 9 and further comprising a control element opening in said crankcase (3) permitting insertion of said control element (19').

* * * * *